US007563393B2

(12) United States Patent
Hayakawa et al.

(10) Patent No.: US 7,563,393 B2
(45) Date of Patent: Jul. 21, 2009

(54) CROSSLINKED ELASTOMER BODY FOR SENSOR, AND PRODUCTION METHOD THEREFOR

(75) Inventors: Tomonori Hayakawa, Komaki (JP); Yuuki Saitou, Komaki (JP); Kazunobu Hashimoto, Nagoya (JP); Rentaro Kato, Kasugai (JP)

(73) Assignee: Tokai Rubber Industries, Ltd., Komaki-shi (JP)

( * ) Notice: Subject to any disclaimer, the term of this patent is extended or adjusted under 35 U.S.C. 154(b) by 1 day.

(21) Appl. No.: 11/855,601

(22) Filed: Sep. 14, 2007

(65) Prior Publication Data

US 2008/0067477 A1 Mar. 20, 2008

(30) Foreign Application Priority Data

Sep. 15, 2006 (JP) ..... 2006-250938

(51) Int. Cl.
*H01B 1/00* (2006.01)
*H01B 1/04* (2006.01)
*H01B 1/24* (2006.01)

(52) U.S. Cl. ..... 252/500; 252/502; 252/510

(58) Field of Classification Search ..... 252/500, 252/502, 510

See application file for complete search history.

(56) References Cited

U.S. PATENT DOCUMENTS

| | | | | |
|---|---|---|---|---|
| 4,076,652 | A * | 2/1978 | Ganci et al. | 252/504 |
| 5,178,797 | A * | 1/1993 | Evans | 252/508 |
| 5,476,612 | A * | 12/1995 | Wessling et al. | 252/511 |
| 5,672,297 | A * | 9/1997 | Soane | 252/511 |
| 6,500,597 | B1 | 12/2002 | Patel et al. | |
| 2005/0187324 | A1 | 8/2005 | Yuan et al. | |
| 2005/0271970 | A1 | 12/2005 | Lee et al. | |
| 2005/0282000 | A1 | 12/2005 | Howie | |

FOREIGN PATENT DOCUMENTS

| | | | |
|---|---|---|---|
| DE | 102004032152 | A1 | 1/2006 |
| EP | 1 566 403 | A2 | 8/2005 |
| JP | 3-93109 | A | 4/1991 |
| WO | WO 03/006253 | A1 | 1/2003 |

OTHER PUBLICATIONS

Barrie et al., "Rheology of aqueous carbon black dispersions," Journal of Colloid and Interface Science, 272, pp. 210-217 (2004).*

European Search Report dated Dec. 3, 2007, issued in corresponding European Patent Application No. 07018009.6.

* cited by examiner

*Primary Examiner*—Mark Kopec
*Assistant Examiner*—Jaison P Thomas
(74) *Attorney, Agent, or Firm*—Westerman, Hattori, Daniels & Adrian, LLP.

(57) ABSTRACT

A crosslinked elastomer body is composed of an electrically conductive composition comprising an electrically conductive filler and an insulative elastomer (matrix). The electrically conductive filler is in a spherical particulate form and has an average particle diameter of 0.05 to 100 μm. The electrically conductive filler has a critical volume fraction (φc) of not less than 30 vol % as determined at a first inflection point of a percolation curve at which an insulator-conductor transition occurs with an electrical resistance steeply reduced when the electrically conductive filler is gradually added to the elastomer. A resistance observed under compressive strain or bending strain increases according to the strain over a resistance observed under no strain when the electrically conductive filler is present in a volume fraction not less than the critical volume fraction (φc) in the composition.

5 Claims, 10 Drawing Sheets

CROSSLINKED ELASTOMER BODY FOR SENSOR, AND PRODUCTION METHOD THEREFOR

BACKGROUND OF THE INVENTION

1. Field of the Invention

The present invention relates to a crosslinked elastomer body to be used as a material for a sensor of a resistance increasing type which is designed such that a resistance observed under compressive strain or bending strain increases according to the strain, and to a production method for the crosslinked elastomer body.

2. Description of the Related Art

Conventionally, inorganic strain sensors employing inorganic materials typified by piezoceramic materials are used for detecting stress, acceleration, vibrations and deformation (strain) exerted on a component. However, such an inorganic strain sensor is generally made of a highly rigid material, so that the shape design flexibility of the sensor is limited. Further, a specific sensor material system should be selected and prepared depending on a measurement range of surface pressure, strain, acceleration or the like. Therefore, the advent of a strain sensor capable of sensing a wider measurement range of a physical quantity with the use of the same material system is long-awaited.

In view of this, elastomers are employed instead of the inorganic materials, and a variety of pressure-sensitive electrically-conductive elastomeric materials are proposed which are each prepared by combining an elastomer with an electrically conductive filler (see, for example, Japanese Unexamined Patent Publication No. HEI3(1991)-93109).

The patent publication discloses a sensor of a so-called resistance reducing type which exhibits a higher electrical resistance under no strain but exhibits a reduced electrical resistance under compressive strain. More specifically, when the sensor is under compressive strain, inter-particle distances of the electrically conductive tiller in the elastomeric material are reduced, so that electrical conduction paths are formed by the electrically conductive filler to reduce the resistance. However, the sensor suffers from significant variations in detection value (resistance value) with respect to the strain, because a resistance change responsive to the strain is not necessarily constant. In some cases, the sensor exhibits an increased electrical resistance under greater strain. This makes it difficult to provide stable measurement results. The variations in detection value with respect to the strain occur not only between different sensors but also in a single sensor. The sensor tends to suffer from wider variations in detection value when being deformed in different directions. With less reliable measurement results, the sensor fails to provide sufficiently high measurement accuracy required for industrial applications.

A pressure-sensitive electrically-conductive elastomeric material for the resistance reducing type sensor disclosed in the patent publication significantly varies in detection sensitivity depending on the proportion of the electrically conductive filler blended in the elastomer. Therefore, it is difficult to impart the sensor with intended sensitivity and other measurement characteristics, making it very difficult to design and produce the sensor. Further, the sensor disclosed in the patent publication is simply adapted to detect a compressive deformation degree based on a change in DC resistance. After particles of the blended electrically conductive filler are brought into a certain contact state, the detection value hardly changes. Therefore, the sensor has a drawback such that the detection ranges of external force and stress are narrower.

As described above, the pressure-sensitive electrically-conductive elastomeric materials of the prior art have resistance reducing properties. However, a pressure-sensitive electrically-conductive elastomeric material having a pressure-sensitive resistance increasing property is hitherto unknown In addition, as described above, it is difficult to impart the prior-art elastomeric materials with intended pressure sensing characteristics and other measurement characteristics. Therefore, a sensor employing any of the prior-art elastomeric materials has a narrower measurement range.

In view of the foregoing, it is an object of the present invention to provide a crosslinked elastomer body which has a pressure-sensitive resistance increasing property, higher shape design flexibility and excellent moldability, and is capable of stably sensing a wider measurement range of a physical quantity when used for a sensor (a sensor of a resistance increasing type), and to provide a production method therefor.

SUMMARY OF THE INVENTION

According to a first aspect of the present invention to achieve the aforementioned object, there is provided a crosslinked elastomer body for a sensor, which is composed of an electrically conductive composition comprising an electrically conductive filler and an insulative elastomer as essential components, wherein the electrically conductive filler is in a spherical particulate form and has an average particle diameter of 0.05 to 100 μm, wherein the electrically conductive filler has a critical volume fraction ($\phi c$) of not less than 30 vol % as determined at a first inflection point of a percolation curve at which an insulator-conductor transition occurs with an electrical resistance steeply reduced when the electrically conductive filler is gradually added to the elastomer, wherein the electrically conductive filler is present in a volume fraction not less than the critical volume fraction ($\phi c$) in the composition, whereby a resistance of the elastomer body observed under compressive strain or bending strain increases according to the strain as compared to a resistance of the elastomer body observed under no strain.

According to a second aspect of the present invention, there is provided a production method for producing the crosslinked elastomer body, the production method comprising the steps of: providing an electrically conductive filler of a spherical particulate form having an average particle diameter of 0.05 to 100 μm and an insulative elastomer; preparing an electrically conductive composition by mixing the electrically conductive filler and the elastomer as essential components and a vulcanizing agent as an optional component, the electrically conductive filler being present in a volume fraction of not less than 30 vol % in the electrically conductive composition; and forming the electrically conductive composition into a predetermined shape and then crosslinking the composition.

The inventors of the present invention have conducted intensive studies to provide a crosslinked elastomer body which has a pressure-sensitive resistance increasing property, higher shape design flexibility and excellent moldability, and is capable of stably sensing a wider measurement range of a physical quantity when used for a sensor (a sensor of a resistance increasing type).

FIG. 1 schematically illustrates a percolation curve showing a relationship between the volume fraction of an electrically conductive filler and the electrical resistance of an electrically conductive composition essentially containing the electrically conductive filler and an insulative elastomer. In general, when the electrically conductive filler 2 is gradually added to the insulative elastomer (matrix) 1, the electrical resistance of the resulting composition is substantially equal to that of the elastomer (matrix) 1 at the initial stage. However, when the volume fraction of the electrically conductive filler 1 reaches a certain level (at a first inflection point of the percolation curve), an insulator-conductor transition occurs with the electrical resistance steeply reduced. The volume fraction of the electrically conductive filler 2 at the first inflection point is herein defined as a critical volume fraction (ϕc). When the volume fraction of the electrically conductive filler 2 thereafter reaches another certain level (at a second inflection point of the percolation curve), a change in electrical resistance is reduced to be saturated even with further addition of the electrically conductive filler 2. The volume fraction of the electrically conductive filler 2 at the second inflection point is herein defined as a saturated volume fraction (ϕs). The series of electrical resistance changes, which is expressed by the percolation curve, occurs supposedly because continuous electrical conduction paths 3 are formed by the electrically conductive tiller 2 in the elastomer (matrix) 1 (see FIG. 1). In general, where an electrically conductive filler such as a carbon black has a smaller average particle diameter, the filler has a greater specific surface area and a greater inter-particle surface adsorption/agglomeration energy. Therefore, several to several tens primary particles of the electrically conductive filler are agglomerated, so that the electrically conductive filler particles are less liable to be present in the form of primary particles in the elastomer. The electrically conductive filler having a smaller average particle diameter and hence liable to be present in the form of secondary particles tends to form an electrically conductive filler network structure in the elastomer. Therefore, the electrically conductive filler causes a percolation phenomenon at a critical volume fraction (ϕc) of about 20vol % to be thereby imparted with electrical conductivity due to formation of continuous electrical conduction paths. Where the electrically conductive filler is liable to agglomerate and hence has a lower percolation critical volume fraction (ϕc), a change in electrical conductivity is less responsive to the strain, and it is supposedly difficult to control the electrical conductivity change with respect to the strain. In the case of the pressure-sensitive electrically-conductive elastomeric material of the resistance reducing type, on the other hand, an electrically conductive filler having a higher percolation critical volume fraction (ϕc) and hence less liable to agglomerate is dispersed in the elastomer. Therefore, the pressure-sensitive electrically-conductive elastomer body serves as an insulator under no strain because of greater inter-particle distances of the electrically conductive filler, but serves as a conductor under compressive strain because of formation of continuous electrical conduction paths by the electrically conductive filler.

In consideration of the relationship between the percolation phenomenon caused by the electrically conductive filler and the critical volume fraction (ϕc) of the electrically conductive filler, the inventors of the present invention have conducted further studies to provide an elastomeric material having a pressure-sensitive resistance increasing property for improvement over the elastomeric material of the pressure-sensitive resistance reducing type and found, beyond common sense knowledge, that advantageous results are obtained by using a greater amount of a filler having a relatively large average particle diameter. More specifically, where an electrically conductive filler having a relatively large average particle diameter and expected to be mostly present in the form of primary particles in an elastomeric material and a crosslinked elastomer (matrix) having higher affinity for the filler are selected and the electrically conductive filler has a percolation critical volume fraction (ϕc) of not less than 30 vol %, the filler can be dispersed in a non-agglomerated state in the elastomer. Where the crosslinked elastomer body contains the electrically conductive filler at a high concentration, i.e., in a volume fraction (packing amount) not less than the critical volume fraction (ϕc), the electrically conductive filler 2 is present substantially in the closest packed state in the crosslinked elastomer (matrix) 1 as shown in FIG. 2. Therefore, when neither compressive strain nor bending strain is applied to the elastomer body, particles of the electrically conductive filler 2 are brought into contact with one another with the intervention of thin film-like elastomer portions (not shown), thereby forming three-dimensional electrical conduction paths (as indicated by arrows in FIG. 2). Thus, the elastomer body exhibits higher electrical conductivity (lower resistance). On the other hand, when the elastomer body is under compressive strain or bending strain, the packed state of the electrically conductive filler particles 2 is changed from the closest packed state due to spatial repulsion of the filler particles. Therefore, the electrically conductive filler particles 2 are brought out of contact with one another, so that the three-dimensional electrical conduction paths (indicated by the arrows in FIG. 2) are destroyed. Thus, the inventors of the present invention have found that a resistance observed under compressive strain or bending strain is increased according to the strain over a resistance observed under no strain and hence the electrical conductivity is reduced (with a higher resistance), and attained the present invention.

For the inventive crosslinked elastomer body for the sensor, the electrically conductive filler having a relatively great average particle diameter and expected to be mostly present in the form of primary particles in the elastomer and hence having a percolation critical volume fraction (ϕc) of not less than 30 vol % is employed in combination with the crosslinked elastomer (matrix) having higher affinity for the filler. Therefore, the electrically conductive filler is dispersed in a non-agglomerated state in the elastomer, and is present at a high concentration, i.e., in a volume fraction (packing amount) not less than the critical volume fraction (ϕc), in the elastomer. Therefore, the electrically conductive filler particles are present substantially in the closest packed state in the crosslinked elastomer (matrix). When neither compressive strain nor bending strain is applied to the elastomer body, the filler particles are brought into contact with one another with the intervention of thin film-like elastomer portions, thereby forming three-dimensional electrical conduction paths. Thus, the elastomer body exhibits higher electrical conductivity (lower resistance). On the other hand, when the elastomer body is under compressive strain or bending strain, the packed state of the electrically conductive filler particles is changed from the closest packed state due to spatial repulsion of the filler particles. Therefore, the filler particles are brought out of contact with one another, so that the three-dimensional electrical conduction paths are destroyed. Since the resistance observed under the compressive strain or bending strain is thus increased according to the strain over the resistance observed under no strain, the electrical conductivity is reduced (with an increased resistance). The initial electrical conductivity (resistance) of the inventive crosslinked elastomer body for the sensor can be controlled within a predetermined range by properly selecting the type and the amount of the electrically conductive filler to be added, and the resistance changing range of the elastomer body can be controlled from one order to five or more orders of magnitude. Therefore, a dynamic range can be selected to provide a resistance changeable sensor capability. Further, it is possible to control the electrical conductivity (resistance) observed under no strain as well as the rate of increase in DC resistance or impedance with respect to the strain, i.e., the strain-responsive sensitivity.

The electrically conductive filler preferably has a saturated volume fraction (ϕs) of not less than 35 vol % as determined at a second inflection point of the percolation curve at which a change in electrical resistance is reduced to be saturated even with further addition of the electrically conductive filler. In this case, the closest packed state of the electrically conductive filler particles is stabilized, so that the resistance increase is liable to occur due to a change in inter-particle contact state of the electrically conductive filler in response to the strain. Further, where the volume fraction (packing amount) of the electrically conductive filler is not less than the saturated volume fraction (ϕs), the resistance is lower, so that the range of the resistance increase with respect to the strain (conductor-insulator transition range) is broadened.

A gel fraction as calculated from the following expression (1) is preferably not greater than 15%;

$$\text{Gel Fraction}(\%) = \frac{(Wg - Wf)}{Wf} \times 100, \quad (1)$$

wherein Wg is the weight of an insoluble portion of the electrically conductive composition obtained by dissolving the electrically conductive composition in a good solvent for the elastomer before crosslinking (the weight of a gel of the electrically conductive filler and the elastomer), and Wf is the weight of the electrically conductive filler. En this case, only a small fraction of the elastomer is adsorbed and bonded to secondary particles of the electrically conductive filler and the electrically conductive filler particles are dispersed in a non-agglomerated state in the elastomer.

Where the elastomer is at least one selected from the group consisting of silicone rubbers, ethylene-propylene copolymer rubbers, natural rubbers, styrene-butadiene copolymer rubbers, acrylonitrile-butadiene copolymer rubbers and acryl rubbers, the elastomer has excellent compatibility with the electrically conductive filler.

The crosslinked elastomer body has opposite strain application surfaces, at least one of which is fitted with a restriction plate. In this case, the resistance increase responsive to the bending strain can be promoted.

Since a general purpose elastomer is used, the present invention ensures excellent moldability and permits flexible design of physical properties (elastic modulus and the like) of the elastomer body. Therefore, the present invention can provide a sensor material which has a Young's modulus suitable for an intended sensing range.

DETAILED DESCRIPTION OF PREFERRED EMBODIMENTS

Embodiments of the present invention will hereinafter be described in detail

An inventive crosslinked elastomer body is employed for a sensor of a resistance increasing type which is designed such that a resistance thereof observed under compressive strain or bending strain increases according to the strain.

In the present invention, the expression "a resistance observed under compressive strain or bending strain increases according to the strain" means that, when the compressive or bending strain is applied, the DC resistance or the impedance of the elastomer body is generally proportional to the strain.

The inventive crosslinked elastomer body is such that an electrically conductive filler having a relatively great particle diameter and expected to be mostly present in the form of primary particles are dispersed in a non-agglomerated state in a crosslinked elastomer (matrix) having higher affinity for the filler, and has a critical volume fraction (ϕc) of not less than 30 vol %.

Figure 1:
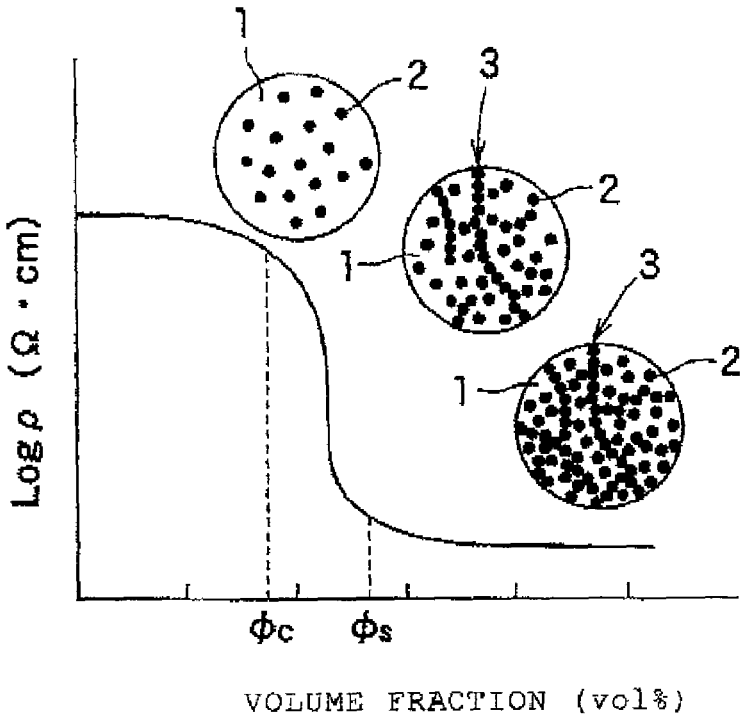
FIG. 1 schematically illustrates a percolation curve showing a relationship between the volume fraction of an electrically conductive filler and the electrical resistance of an electrically conductive composition essentially containing the electrically conductive filler and an insulative elastomer.
Figure 2:
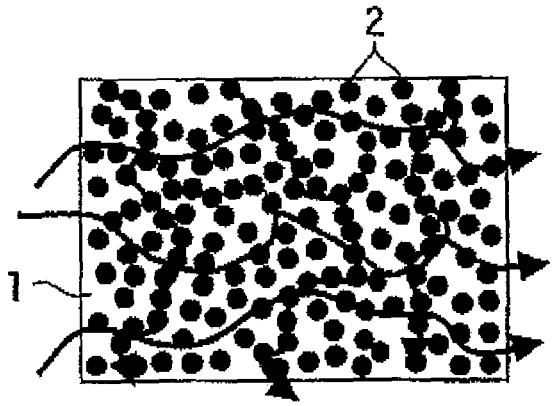
FIG. 2 is a schematic diagram showing the electrical conductivity exhibiting mechanism of an inventive crosslinked elastomer body for a sensor (under no strain).
Figure 3:
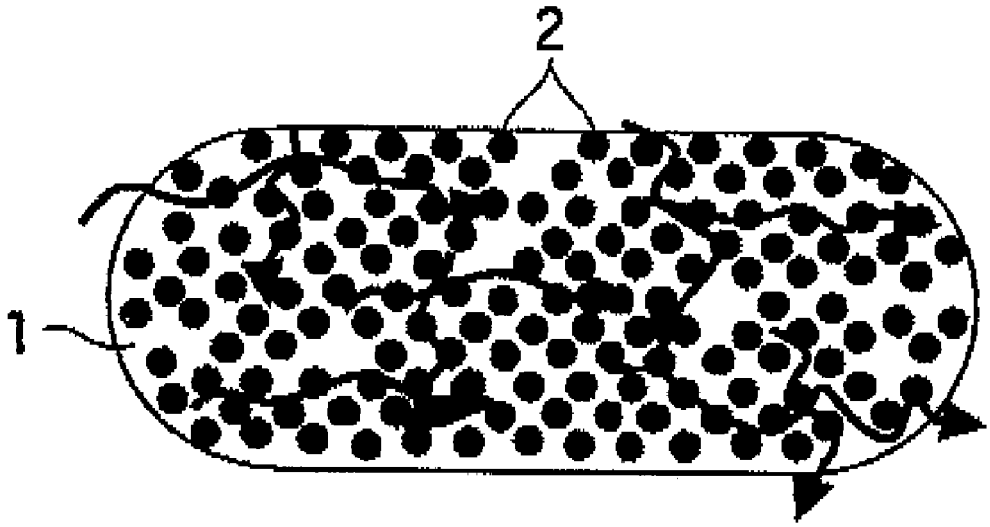
FIG. 3 is a schematic diagram showing the electrical conductivity exhibiting mechanism of the inventive crosslinked elastomer body (under compressive strain).

In the present invention, as shown in FIG. 2, particles of the electrically conductive filler 2 are present substantially in the closest packed state in the crosslinked elastomer (matrix) 1. Therefore, when neither compressive strain nor bending strain is applied to the elastomer body, the electrically conductive filler particles 2 are brought into contact with one another with the intervention of thin film-like elastomer portions (not shown) to form three-dimensional electrical conduction paths (as indicated by arrows in FIG. 2). Thus, the elastomer body exhibits higher electrical conductivity (lower resistance). On the other hand, when the elastomer body is under compressive strain or bending strain, as shown in FIG. 3, the packed state of the electrically conductive filler particles 2 is changed from the closest packed state due to spatial repulsion of the filler particles. Therefore, the electrically conductive filler particles 2 are brought out of contact with one another, so that the three-dimensional electrical conduction paths (indicated by the arrows in FIG. 2) are destroyed. A major feature of the present invention is that the resistance of the elastomer body observed under compressive strain or bending strain increases according to the strain over the resistance observed under no strain, and the electrical conductivity is reduced (with a higher resistance).

In the present invention, the expression "the electrically conductive filler particles are in a non-agglomerated state" means that most (generally 50 wt % or more) of the electrically conductive filler particles are present in the form of primary particles but not agglomerated into secondary particles.

The electrically conductive filler is not particularly limited, as long as it is an electrically conductive particulate filler. Examples of the electrically conductive filler include carbon fillers such as carbon blacks and fine particulate metal fillers, which may be used either alone or in combination. Among these fillers, a filler which is mostly present in the form of primary particles but not agglomerated into secondary particles in the elastomer is preferred. More specifically, a spherical carbon black filler is preferred. This is based on the fact that the carbon filler has higher affinity for the organic elastomer and is liable to be present in the form of primary particles in the elastomer. Further, the spherical particulate form of the filler permits the filler to be present substantially in the closest packed state in the elastomer even if the filler is in a non-oriented state (a non-spherical shape-anisotropic filler is less liable to be present in the packed state if it is in a non-oriented state), and substantially prevents the filler from exhibiting directional anisotropy in response to a change in the inter-particle contact state of the filler under strain.

The electrically conductive filler typically has an average particle diameter (primary particle diameter) of 0.05 to 100 μm, preferably 0.5 to 60 μm, particularly preferably 1 to 30 μm. If the average particle diameter of the electrically conductive filler is thus relatively great, the electrically conductive filler is expected to be mostly present in the form of primary particles even in the crosslinked elastomer. If the average particle diameter (primary particle diameter) of the electrically conductive filler is less than 0.05 μm, the electrically conductive filler particles are liable to be agglomerated into secondary particles in the crosslinked elastomer, so that the percolation critical volume fraction (ϕc) tends to be reduced to less than 30 vol %. Conversely, if the average particle diameter (primary particle diameter) of the electrically conductive filler is greater than 100 μm, the translation motion (parallel motion) of the electrically conductive filler particles occurring due to the strain is liable to be smaller than the particle diameters, so that a change in electrical conductivity tends to be less responsive to the strain.

The electrically conductive filler preferably has a D90/D10 ratio of not greater than 30, particularly preferably 1 to 10, in its particle diameter frequency distribution. If the D90/D10 ratio is greater than 30, the particle diameter distribution is too broad, so that the change in electrical conductivity with respect to the strain tends to be unstable to deteriorate the repeatability. In the present invention, a plurality of electrically conductive fillers each having a narrower particle diameter distribution may be used in combination. In this case, the combination of the electrically conductive fillers preferably has a D90/D10 ratio of not greater than 100 in their combined particle diameter frequency distribution.

The electrically conductive filler particles each preferably have an aspect ratio of 1 to 2 as defined by the ratio of a major axis to a minor axis thereof, and preferably each have a substantially spherical shape. That is, electrically conductive filler particles each having a fibrous shape or a scale-like shape with a greater aspect ratio are liable to be brought into contact with one another even in a non-oriented state to form electrical conduction paths, so that the percolation critical volume fraction (ϕc) tends to be reduced to less than 30 vol %. In the presence of the electrically conductive filler particles each having a greater aspect ratio, a reduction in the number of the electrical conduction paths (an increase in resistance) with respect to the strain tends to be suppressed.

In the present invention, an electrically conductive filler of a spherical particulate form having an average particle diameter of 0.05 to 100 μm may be employed in combination with the other type of electrically conductive filler (e.g., an electrically conductive filler of a needle-shaped particulate form or the like).

The electrically conductive filler is preferably a spherical carbon black. Specific examples of the spherical carbon black include mesocarbon microbeads MCMB6-28 (having an average particle diameter of about 6 μm), MCMB10-28 (having an average particle diameter of about 10 μm), and MCMB25-28 (having an average particle diameter of about 25 μm) available form Osaka Gas Chemical Co., Ltd., carbon microbeads NICABEADS ICE, NICABEADS PC, NICABEADS MC and NICABEADS MSB including ICB0320 (having an average particle diameter of about 3 μm), ICB0520 (having an average particle diameter of about 5 μm), ICB1020 (having an average particle diameter of about 10 μm), PC0720 (having an average particle diameter of about 7 μm) and MC0520 (having an average particle diameter of about 5 μm) available from Nippon Carbon Co., Ltd., and carbon beads (having an average particle diameter of about 10 μm) available from Nisshinbo Industries Inc.

The volume fraction of the electrically conductive filler ([the volume of the electrically conductive filler]/[the volume of the electrically conductive composition]×100) is preferably not less than 30 vol %, particularly preferably 30 to 65 vol %, most preferably 35 to 55 vol %, based on the total of the electrically conductive composition. If the volume fraction of the electrically conductive filler is less than 30 vol %, the electrically conductive filler is not substantially in the closest packed state, so that the electrical conductivity tends to be deteriorated.

In the present invention, the elastomer is employed in combination with the electrically conductive filler. In the present invention, the elastomer is not limited to narrower-sense elastomers such as thermoplastic elastomers, but is intended to include broader-sense elastomers such as rubbers.

Usable as the elastomer is an elastomer which has higher affinity for the electrically conductive filler and ensures that the electrically conductive filler has a percolation critical volume fraction (ϕc) of not less than 30 vol %, preferably not less than 35 vol %, when being blended in the elastomer. If the critical volume fraction (ϕc) of the electrically conductive filler is less than 30 vol %, the electrically conductive filler particles are not stably present in a non-agglomerated state in the elastomer, but agglomerated to form a network structure. Therefore, a change in electrical conductivity is smaller when the strain is applied to the elastomer body.

The elastomer preferably has a gel fraction of not greater than 15%, particularly preferably not greater than 10%, as calculated from the expression (1) described above. The gel fraction serves as an indication of the percolation critical volume fraction (ϕc). If the percolation critical volume fraction (ϕc) is less than 30 vol %, a greater fraction of the elastomer is adsorbed and bonded to secondary particles of the electrically conductive filler, and the elastomer has a greater gel fraction. On the other hand, if the percolation critical volume fraction (ϕc) is not less than 30 vol %, the electrically conductive filler particles are dispersed in a non-agglomerated state in the elastomer, so that a smaller fraction of the elastomer is adsorbed and bonded to the secondary particles of the electrically conductive filler, and the elastomer has a smaller gel fraction on the order of not greater than 15%.

Examples of the good solvent for the elastomer include toluene, tetrahydrofuran and chloroform. The solvent desirably has an SP value (solubility parameter value) close to that of the elastomer.

Examples of the elastomer include rubbers such as natural rubbers (NRs), isoprene rubbers (IRs), butadiene rubbers (BRs), acrylonitrile-butadiene copolymer rubbers (NBRs), styrene-butadiene copolymer rubbers (SBRs), ethylene-propylene copolymer rubbers including ethylene-propylene-diene terpolymers (EPDMS) and ethylene-propylene copolymers (EPMs), butyl rubbers (IIRs), halogenated butyl rubbers including Cl-IIRs and Br-IIRs, hydrogenated nitrile rubbers (H-NBRs), chloroprene rubbers (CRs), acryl rubbers (ARs), chlorosulfonated polyethylene rubbers (CSMs), hydrin rubbers, silicone rubbers, fluororubbers, urethane rubbers and synthetic latexes, and a variety of thermoplastic elastomers and their derivatives including styrene elastomers, olefin elastomers, urethane elastomers, polyester elastomers, polyamide elastomers, fluorinated elastomers, which may be used either alone or in combination. Among these elastomers, EPDMs which are highly compatible with the electrically conductive filler, and NBRs and silicone rubbers which are compatible with the electrically conductive filler are advantageously employed.

In the electrically conductive composition, a vulcanizing agent, a vulcanization accelerating agent, a vulcanization assisting agent, an anti-aging agent, a plasticizer and a softener may be blended, as required, with the essential components including the electrically conductive filler and the elastomer.

The inventive crosslinked elastomer body for the sensor is produced, for example, in the following manner. The elastomer is prepared as an essential component and, as required, zinc oxide, stearic acid, a paraffin process oil and the like are added to the elastomer. Then, the resulting mixture is kneaded by a roll kneader. In turn, the electrically conductive filler is added as another essential component, and mixed and dispersed in the resulting mixture by the roll kneader. As required, a vulcanizing agent, a vulcanization accelerating agent and the like are added, and mixed and dispersed in the resulting mixture by the roll kneader. Thus, the electrically conductive composition is prepared. Then, the electrically conductive composition is formed into an uncrosslinked rubber sheet, filled in a mold, and press-vulcanized in a predetermined temperature environment (e.g., at 170° C. for 30 minutes). Thus, the intended crosslinked elastomer body (crosslinked product of the electrically conductive composition) is produced.

A major feature of the inventive crosslinked elastomer body is that the electrically conductive filler has a critical volume fraction (ϕc) of not less than 30 vol % as determined at a first inflection point of a percolation curve at which an insulator-conductor transition occurs with the electrical resistance steeply reduced when the electrically conductive filler is gradually added to the elastomer, and the resistance observed under compressive strain or bending strain increases according to the strain over the resistance observed under no strain when the electrically conductive filler is present in a volume fraction (packing amount) not less than the critical volume fraction (ϕc).

In the inventive crosslinked elastomer body, the critical volume fraction (ϕc) of the electrically conductive filler should be not less than 30 vol %, preferably not less than 35 vol %. If the critical volume fraction (ϕc) is less than 30 vol %, the electrically conductive filler particles are not stably present in a non-agglomerated state in the elastomer. Therefore, the electrically conductive filler particles are liable to agglomerate to form a network structure, so that the change in the electrical conductivity with respect to the strain is poorer.

In the inventive crosslinked elastomer, the electrically conductive filler preferably has a saturated volume fraction (ϕs) of not less than 35 vol %, particularly preferably not less than 40 vol %. In this case, the electrically conductive filler particles are stably present in the closest packed state, so that the resistance increase more apparently occurs due to a change in the inter-particle contact state of the electrically conductive filler in response to the strain. Further, the resistance is lower, so that the range of the resistance increase with respect to the strain (conductor-insulator transition range) is broadened.

The critical volume fraction (ϕc) or the saturated volume fraction (ϕs) can be adjusted within the aforesaid range by properly selecting a combination of the electrically conductive filler and the elastomer.

Figure 4:
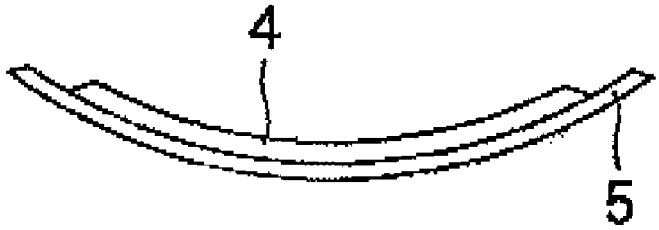
FIG. 4 is a schematic diagram illustrating one example of the inventive crosslinked elastomer body with a restriction plate attached to one surface thereof.
Figure 5:
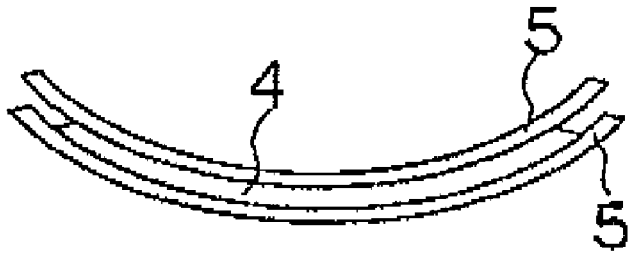
FIG. 5 is a schematic diagram illustrating another example of the inventive crosslinked elastomer body with restriction plates attached to opposite surfaces thereof.

A restriction plate 5 (FIG. 4) or restriction plates 5 (FIG. 5) are preferably attached to one or both of opposite strain application surfaces 4 of the crosslinked elastomer body to promote the resistance increase occurring due to the bending strain.

The restriction plate 5 is not particularly limited, but examples thereof include resin films such as of polyethylenes (PEs), polyethylene terephthalates (PETs) and polyimides (PIs), and metal plates such as vibration suppressing steel plates.

The inventive crosslinked elastomer body serves as an electrical conductor (or a semiconductor) having a volume resistance of not greater than about 100 MΩ·cm when neither compressive strain nor bending strain is applied to the elastomer body (under no strain), but serves as an insulator with an increased resistance under compressive strain or bending strain. In this case, the initial electrical conductivity (resistance) of the elastomer body can be controlled within a predetermined range by properly selecting the type and the amount of the electrically conductive filler to be added, and the range of the resistance change can be controlled from one order to five or more orders of magnitude. Therefore, a dynamic range can be selected to provide a resistance changeable sensor capability.

EXAMPLES

Examples of the present invention and comparative examples will hereinafter be described. However, it is noted that the present invention be not limited to these examples.

Example 1

Preparation of Crosslinked EPDM Containing Spherical Particulate Carbon Filler (High Conductor)

First, 85 parts by weight (hereinafter referred to simply as "parts") (85 g) of an oil extension ethylene-propylene-diene terpolymer (EPDM)(ESPRENE 6101 available from Sumitomo Chemical Co., Ltd.), 34parts (34 g) of an oil extension EPDM-(ESPRENE 601 available from Sumitomo Chemical Co., Ltd.), 30 parts (30 g) of an EPDM (ESPRENE 505 available from Sumitomo Chemical Co., Ltd.), 5 parts (5 g) of zinc oxide (two types of zinc oxide available from Hakusui Tech Co., Ltd.), 1 part (1 g) of stearic acid (LUNAC S30 available from Kao Corporation) and 20 parts (20 g) of a paraffin process oil (SUNPAR 110 available from Nippon Sun Oil Company) were kneaded by a roll kneader. Then, 270 parts (270 g) of a spherical particulate carbon filler (NICABEADS ICB0520 available from Nippon Carbon Co., Ltd.) having an average particle diameter of 5 μm and a D90/D10 ratio of 3.2 in particle diameter frequency distribution was added, and mixed and dispersed in the resulting mixture by the roll kneader. In turn, 1.5 parts (1.5 g) of zinc dimethyldithiocarbamate (NOCCELER PZ-P available from Ouchi Shinko Chemical Industry Co., Ltd.) as a vulcanization accelerating agent, 1.5 parts (1.5 g) of tetramethylthiuram disulfide (SANCELER TT-G available from Sanshin Chemical Industry Co., Ltd.) as a vulcanization accelerating agent, 0.5 parts (0.5 g) of 2-mercaptobenzothiazole (NOCCELER M-P available from Ouchi Shinko Chemical Industry Co., Ltd.) as a vulcanization accelerating agent and 0.56 parts (0.56 g) of sulfur (SULFAX T-10 available from Tsurumi Chemical Industry Co., Ltd.) were added, and mixed and dispersed in the resulting mixture by the roll kneader. Thus, an electrically conductive composition was prepared. The spherical particulate carbon filler (electrically conductive filler) was present in a volume fraction of about 48 vol % in the electrically conductive composition, and had a percolation critical volume fraction (ϕc) of 43 vol % and a saturated volume fraction (ϕs) of 48 vol %. The gel fraction was about 3% which was determined by dissolving the uncrosslinked electrically conductive composition in a good solvent (toluene) and measuring the amount of an insoluble portion of the composition.

Figure 6:
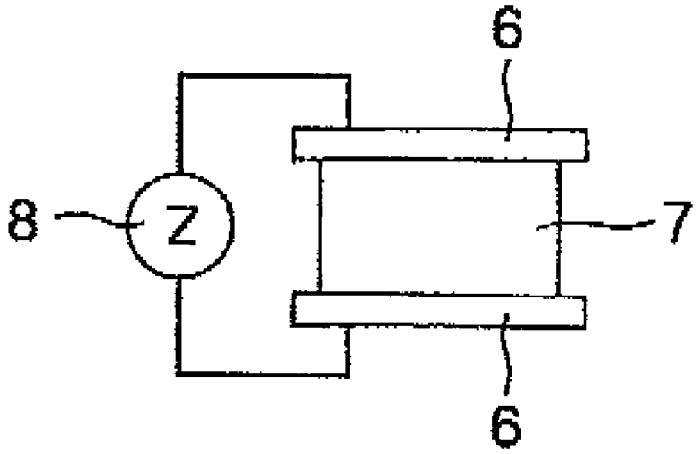
FIG. 6 is a schematic diagram showing measurement of the impedance of a crosslinked elastomer body fixed between electrodes (under no strain).
Figure 7:
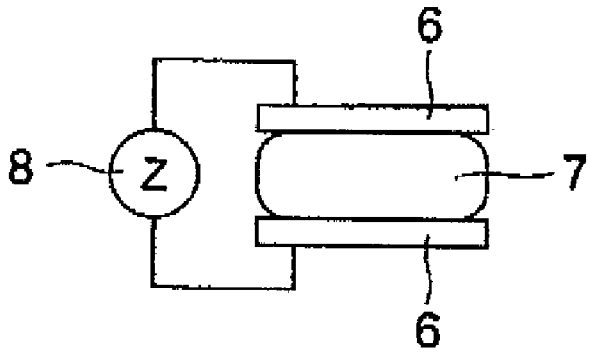
FIG. 7 is a schematic diagram showing measurement of the impedance of the crosslinked elastomer body fixed between the electrodes (under compressive strain).

Subsequently, the electrically conductive composition was formed into an uncrosslinked rubber sheet having dimensions of 150 mm×1500 mm×2 mm (thickness). The uncrosslinked rubber sheet was filled in a rectangular box-shaped mold having dimensions of 10 mm×10 mm×5 mm (height), and press-vulcanized at a temperature of 170° C. for 30 minutes with a pair of copper plates (electrodes) 6 attached to vertically opposite end faces of the filled sheet. Thus, a sensor body 7 of a crosslinked EPDM (crosslinked product) with the electrodes 6 attached thereto was prepared as shown in FIG. 6. The sensor body was evaluated by employing an impedance measuring apparatus 8 adapted to measure impedance in an electrical circuit based on an AC current and voltage. Used as the impedance measuring apparatus 8 were dielectric test electrode bars (HP-16451B available from Hewlett-Packard Company) and an impedance analyzer (HP-4194A available from Hewlett-Packard Company). By means of the impedance meter 8, as shown in FIG. 7, impedance-frequency characteristics (Z-f) were determined with a thicknesswise compressive strain applied to the sensor body. The results are shown in FIG. 8.

Figure 8:
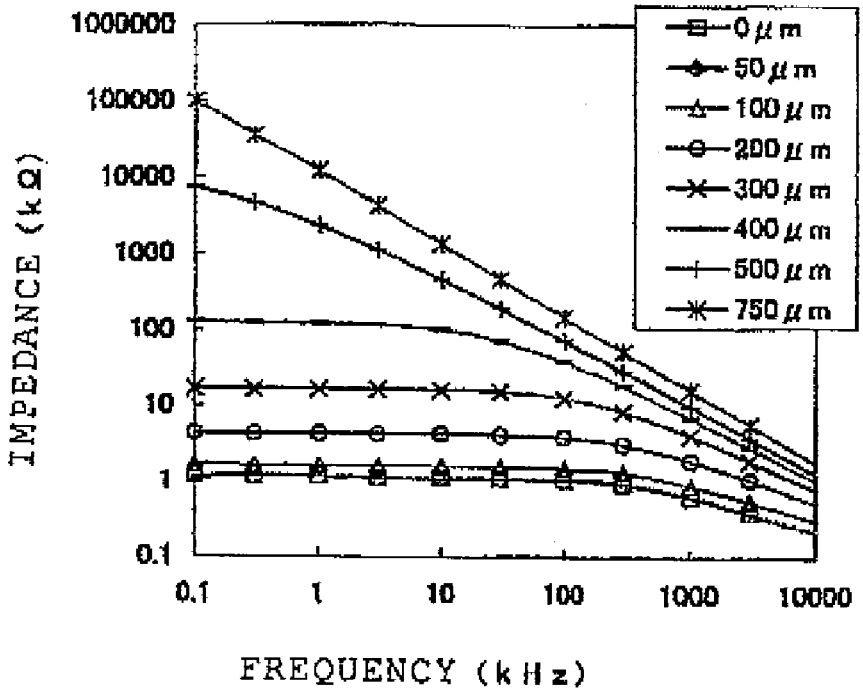
FIG. 8 is a graph showing the impedance-frequency characteristics (Z-f) of Example 1 for different static compressive strains.

As indicated by the results shown in FIG. 8, impedance observed at 0.1 kHz under no strain was about 1 kΩ, and increased with the strain. When a compressive strain of 500 μm (10% strain) was applied to the sensor body, the impedance was about 10 MΩ ($10^4$ kΩ). When a greater compressive strain was further applied to the sensor body, the impedance was increased to about 100 MΩ ($10^5$ kΩ) or greater. That is, the crosslinked product was transformed from a conductor to an insulator with its resistance R changed from about 1 kΩ by 5 orders of magnitude by the application of the compressive strain.

Example 2

Preparation of Crosslinked EPDM Containing Spherical Particulate Carbon Filler (Intermediate Conductor)

An electrically conductive composition was prepared in substantially the same manner as in Example 1, except that the spherical particulate carbon filler (NICABEADS ICB0520 available from Nippon Carbon Co., Ltd.) was blended in a proportion of 260 parts (260 g) The spherical particulate carbon filler (electrically conductive filler) was present in a volume fraction of about 47 vol % in the electrically conductive composition, and had a percolation critical volume fraction (ϕc) of 43 vol % and a saturated volume fraction (ϕs) of 48 vol. %.

Then, the electrically conductive composition was formed into an uncrosslinked rubber sheet having dimensions of 150 mm×1500 mm×2 mm (thickness) As in Example 1, the uncrosslinked rubber sheet was filled in a rectangular box-shaped mold having dimensions of 10 mm×10 mm×5 mm (height), and press-vulcanized at a temperature of 170° C. for 30 minutes with a pair of copper plates (electrodes) 6 attached to vertically opposite end faces of the filled sheet. Thus, a sensor body 7 of a crosslinked EPDM (crosslinked produce) with the electrodes 6 attached thereto was prepared as shown in FIG. 6. As in Example it impedance-frequency characteristics (Z-f) were determined with a thicknesswise compressive strain applied to the sensor body as shown in FIG. 7. The results are shown in FIG. 9.

Figure 9:
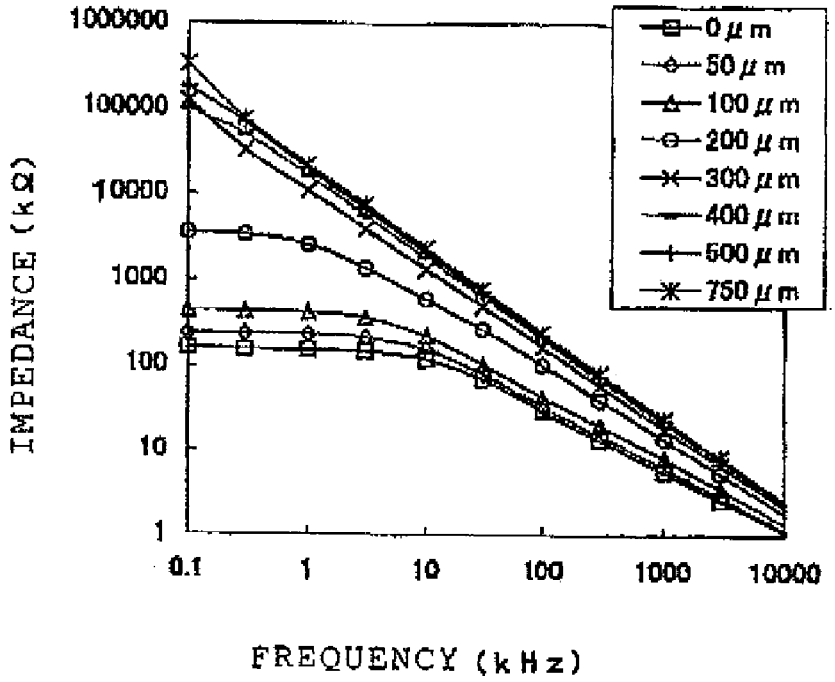
FIG. 9 is a graph showing the impedance-frequency characteristics (Z-f) of Example 2 for different static compressive strains.

As indicated by the results shown in FIG. 9, impedance observed at 0.1 kHz under no strain was about 200 kΩ, and increased with the strain. When a compressive strain of 200 μm (4% strain) was applied to the sensor body, the impedance was about 3 MΩ (3000 kΩ). When a greater compressive strain was further applied to the sensor body, the impedance was increased to 100 MΩ ($10^5$ kΩ) or greater. That is, the crosslinked product was transformed from a semiconductor having a resistance R of about 200 kΩ to an insulator by the application of the compressive strain.

Example 3

Preparation of Crosslinked EPDM Containing Spherical Particulate Carbon Filler (Low Conductor)

An electrically conductive composition was prepared in substantially the same manner as in Example 1, except that the spherical particulate carbon filler (NICABEADS ICB0520 available from Nippon Carbon Co., Ltd.) was blended in a proportion of 240 parts (240 g) The spherical particulate carbon filler (electrically conductive filler) was present in a volume traction of about 45 vol % in the electrically conductive composition, and had a percolation critical volume fraction (ϕc) of 43 vol % and a saturated volume fraction (ϕs) of 48 vol %

Then, the electrically conductive composition was formed into an uncrosslinked rubber sheet having dimensions of 150 mm×1500 mm×2 mm (thickness). As in Example 1, the uncrosslinked rubber sheet was filled in a rectangular box-shaped mold having dimensions of 10 mm×10 mm×5 mm (height), and press-vulcanized at a temperature of 170° C. for 30 minutes with a pair of copper plates (electrodes) 6 attached to vertically opposite end faces of the filled sheet. Thus, a sensor body 7 of a crosslinked EPDM (crosslinked product) with the electrodes 6 attached thereto was prepared as shown in FIG. 6. As in Example 1, impedance-frequency characteristics (Z-f) were determined with a thicknesswise compressive strain applied to the sensor body as shown in FIG. 7. The results are shown in FIG. 10.

Figure 10:
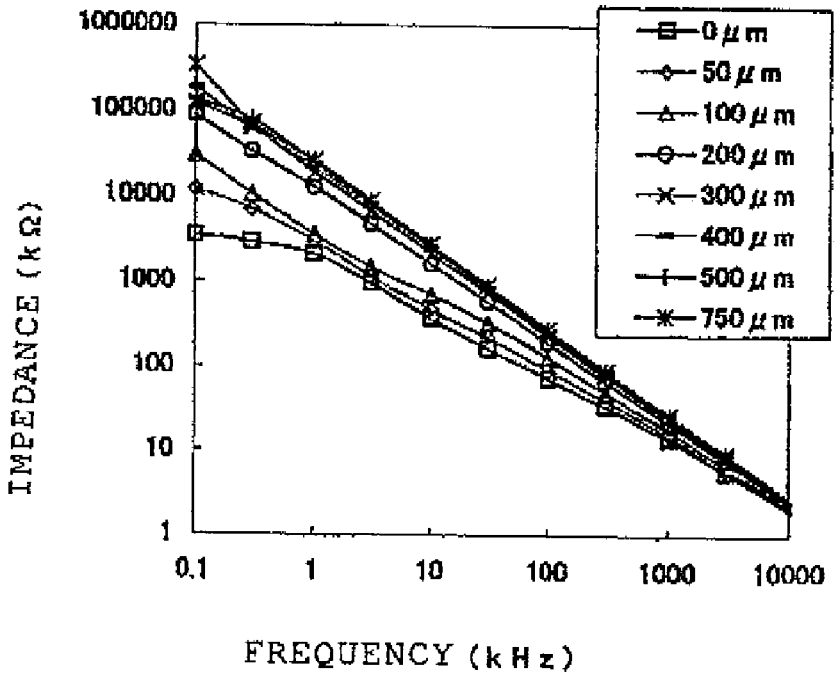
FIG. 10 is a graph showing the impedance-frequency characteristics (Z-t) of Example 3 for different static compressive strains.

As indicated by the results shown in FIG. 10, impedance observed at 0.1 kHz under no strain was about 3 MΩ (3000 kΩ), and increased with the strain. When a compressive strain of 50 μm (1% strain) was applied to the sensor body, the impedance was about 10 MΩ. When a greater compressive strain was further applied to the sensor body, the impedance was increased to 100 MΩ ($10^5$ kΩ) or greater. That is, the crosslinked product was transformed from a semiconductor having a resistance R of about 3 MΩ to an insulator by the application of the compressive strain.

Figure 11:
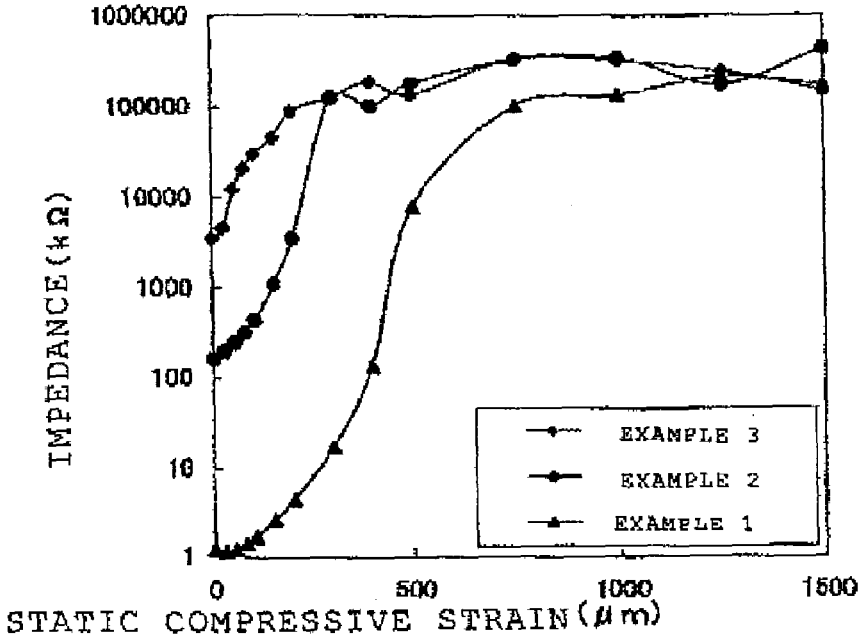
FIG. 11 is a graph showing relationships between the static compressive strain and the impedance at a frequency f of 0.1 kHz in Examples 1, 2 and 3.
Figure 12:
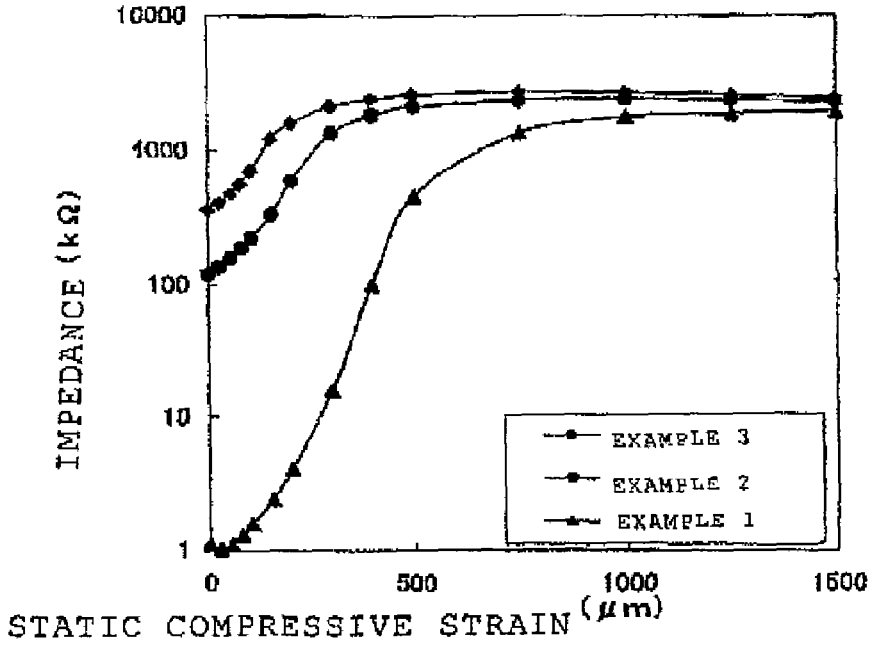
FIG. 12 is a graph showing relationships between the static compressive strain and the impedance at a frequency f of 10 kHz in Examples 1, 2 and 3.
Figure 13:
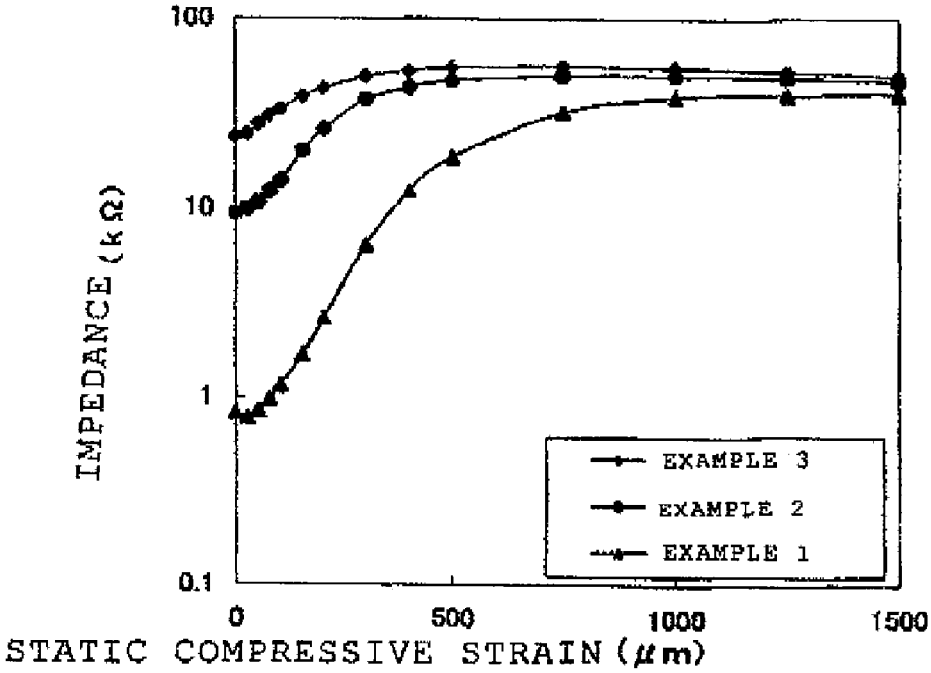
FIG. 13 is a graph showing relationships between the static compressive strain and the impedance at a frequency f of 500 kHz in Examples 1, 2 and 3.

Relationships between the static compressive strain and the impedance at different frequencies (f=0.1 kHz, 10 kHz and 500 kHz) in Examples 1, 2 and 3 are shown in FIGS. 11 to 13. The results shown in FIGS. 11 to 13 indicate that the initial electrical conductivity of each of the crosslinked products (the high conductor of Example 1, the intermediate conductor of Example 2 and the low conductor of Example 3) and the change rate of the electrical conductivity with respect to the static compressive strain are controllable by adjusting the amount of the spherical particulate carbon filter (electrically conductive filler). Further, these crosslinked products are each made of a rubber material, so that the shape design flexibility is higher and the electrical conductivity change rate with respect to the strain is flexibly controllable. Therefore, these crosslinked products are advantageously employed as materials for strain detection sensors.

Example 4

Preparation of Crosslinked Silicone Rubber Containing Spherical Particulate Carbon Filler (High Conductor)

First, 100 parts (200 g) of a silicone rubber (KE931-U available from Shin-Etsu Chemical Co., Ltd) was kneaded by a roll kneader. Then, 78 parts (156 g) of a spherical particulate carbon filler (NICABEADS ICB0520 available from Nippon Carbon Co., Ltd.) was added, and mixed and dispersed in the silicone rubber by the roll kneader. In turn, 2 parts (4.0 g) of a crosslinking agent containing 25% of 2,5-dimethyl-2,5-bis (t-butylperoxy)hexane (C-8 available from Shin-Etsu Chemical Co., Ltd.) was added, and mixed and dispersed in the resulting mixture by the roll kneader. The spherical particulate carbon filler (electrically conductive filler) was present in a volume fraction of about 37 vol % in the resulting electrically conductive composition, and had a percolation critical volume fraction (ϕc) of 34 vol % and a saturated volume fraction (ϕs) of 50 vol %.

Then, the electrically conductive composition was formed into an uncrosslinked rubber sheet having dimensions of 150 mm×1500 mm×2 mm (thickness). As in Example 1, the uncrosslinked rubber sheet was filled in a rectangular box-shaped mold having dimensions of 10 mm×10 mm×3 mm (height), and press-vulcanized at a temperature of 170° C. for 30 minutes with a pair of copper plates (electrodes) 6 attached to vertically opposite end faces of the filled sheet. Thus, a sensor body 7 of a crosslinked silicone rubber (crosslinked product) with the electrodes 6 attached thereto was prepared as shown in FIG. 6. As in Example 1, impedance-frequency characteristics (Z-f) were determined with a thicknesswise compressive strain applied to the sensor body as shown in FIG. 7. The results are shown in FIG. 14.

Figure 14:
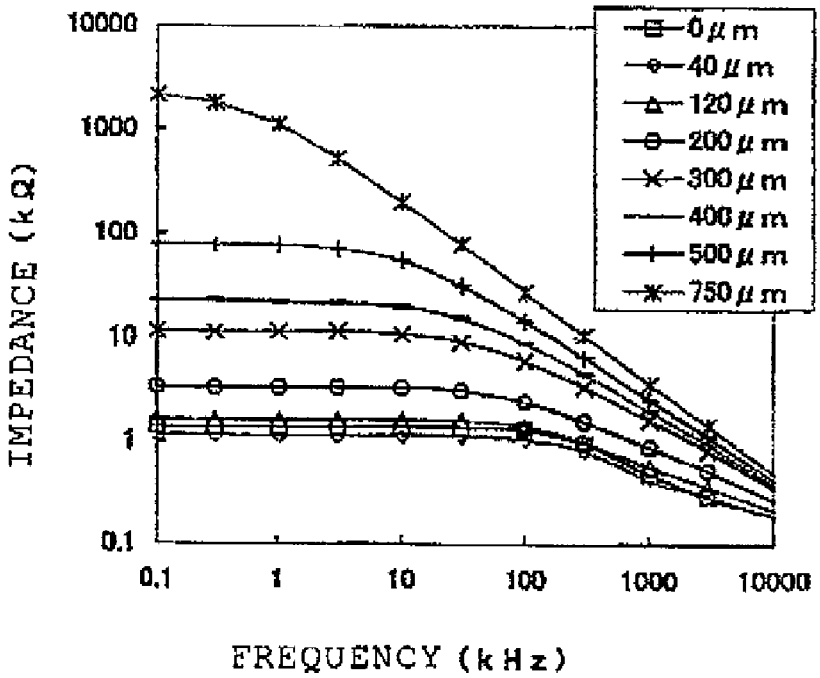
FIG. 14 is a graph showing the impedance-frequency characteristics (Z-f) of Example 4 for different static compressive strains.

As indicated by the results shown in FIG. 14, impedance observed at 0.1 kHz under no strain was about 1 kΩ, and increased with the strain. When a compressive strain of 500 μm (17% strain) was applied to the sensor body, the impedance was about 100 kΩ. When a compressive strain of 750 μm (25% strain) was applied to the sensor body, the impedance was about 2 MΩ (2000 kΩ). When a greater compressive strain was further applied to the sensor body, the impedance was increased to 100 MΩ ($10^5$ kΩ) or greater (not shown). That is, the crosslinked product was transformed from a conductor having a resistance R of about 1 kΩ to an insulator by the application of the compressive strain.

Figure 15:
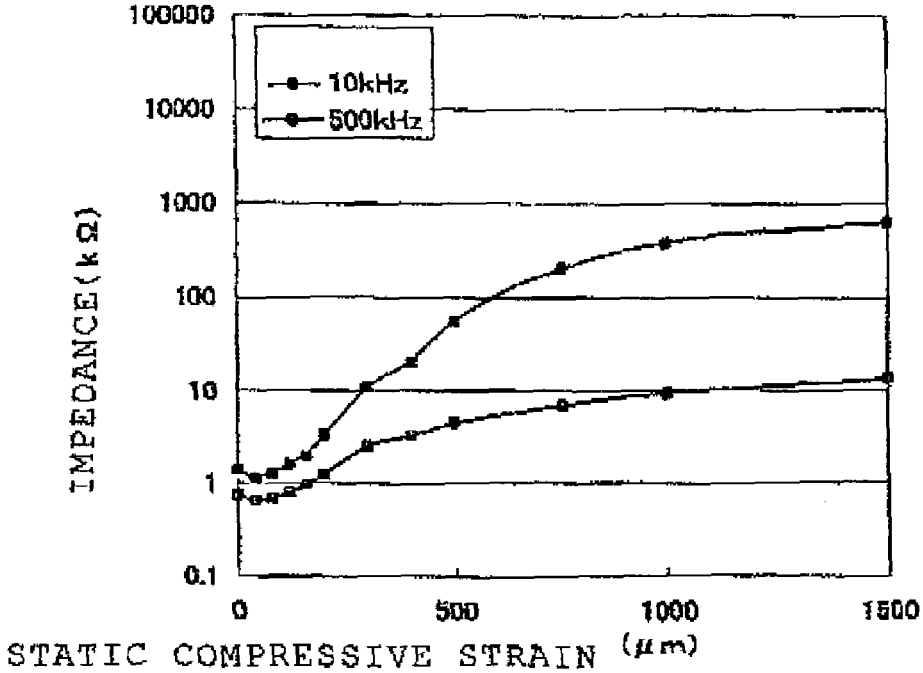
FIG. 15 is a graph showing relationships between the static compressive strain and the impedance at different frequencies in Example 4.

Relationships between the static compressive strain and the impedance at different frequencies (f=10 kHz and 500 kHz) in Example 4 are shown in FIG. 15. The results shown in FIG. 15 indicate that the impedance changes according to the compressive strain in Example 4.

Example 5

Preparation of Crosslinked EPDM Containing Lower-Structured General-Purpose Carbon Black An electrically conductive composition was prepared in substantially the same manner as in Example 1, except that 175 parts (175 g) of a lower-structured general-purpose carbon black (ASAHI-THERMAL available from Asahi Carbon Co. Ltd. and having an average particle diameter of 0.08 μm) was employed instead of the spherical particulate carbon filler (NICABEADS ICB0520 available from Nippon Carbon Co., Ltd.) The lower-structured general-purpose carbon black (electrically conductive filler) was present in a volume fraction of about 32 vol % in the electrically conductive composition, and had a percolation critical volume fraction (ϕc) of 32 vol % and a saturated volume fraction (ϕs) of 50 vol %. The gel fraction was about 11% which was determined by dissolving the uncrosslinked electrically conductive composition in a good solvent (toluene) and measuring the amount of an insoluble portion of the composition.

Then, the electrically conductive composition was formed into an uncrosslinked rubber sheet having dimensions of 150 mm×1500 mm×2 mm (thickness). As in Example 1, the uncrosslinked rubber sheet was filled in a rectangular box-shaped mold having dimensions of 10 mm×10 mm×3 mm (height), and press-vulcanized at a temperature of 170° C. for 30 minutes with a pair of copper plates (electrodes) 6 attached to vertically opposite end faces of the filled sheet. Thus, a sensor body 7 of a crosslinked EPDM (crosslinked product) with the electrodes 6 attached thereto was prepared as shown in FIG. 6. As in Example 1, impedance-frequency characteristics (Z-f) were determined with a thicknesswise compressive strain applied to the sensor body as shown in FIG. 7. The results are shown in FIG. 16.

Figure 16:
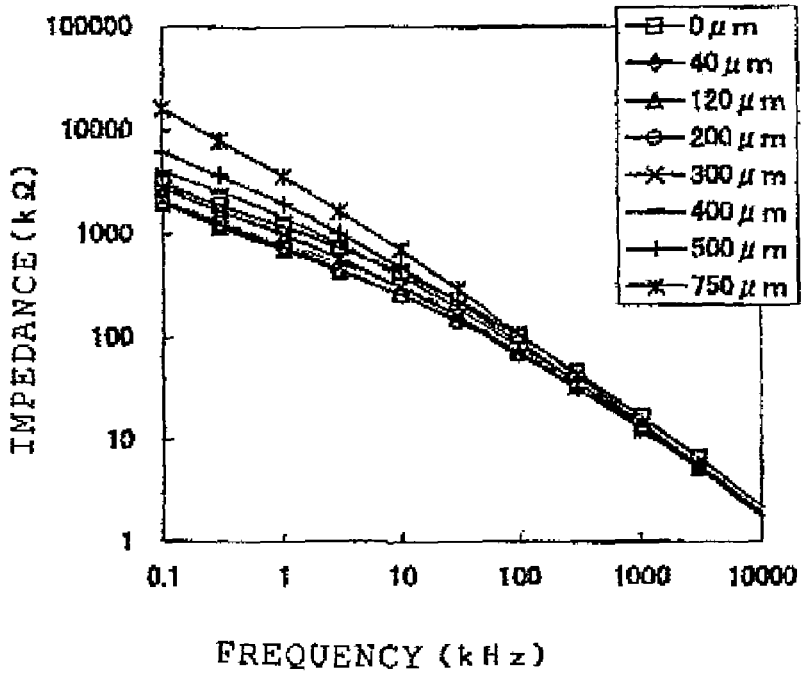
FIG. 16 is a graph showing the impedance-frequency characteristics (Z-f) of Example 5 for different static compressive strains.

As indicated by the results shown in FIG. 16, impedance observed at 0.1 kHz under no strain was about 3 MΩ (3000 kΩ). As compressive stain was increased up to about 200 μm (7% strain), the impedance was reduced. When a greater compressive strain was further applied to the sensor body, the impedance was gradually increased. When a compressive strain of 750 μm (25% strain) was applied to the sensor body, the impedance was about 10 MΩ ($10^4$ kΩ). When a greater compressive strain was further applied to the sensor body, the impedance was gradually increased to 100 MΩ ($10^5$ kΩ) or greater (not shown). That is, the crosslinked product was transformed from a semiconductor having a resistance R of about 3 MΩ to an insulator by the application of the compressive strain. However, the resistance was not monotonically increased according to the compressive strain, so that the crosslinked product may serve as a resistance increasing type rubber sensor only in a compressive strain range of not less than about 7% strain (not less than 200 μm). In Example 5, a rubber sensor of a resistance increasing type operative only in a resistance increasing range may be provided by employing an initial resistance value determined by preliminarily applying a compressive strain of about 200 μm (an offset of about 200 μm). The crosslinked products of Examples 1 to 4 each employing the spherical particulate carbon filler as the electrically conductive filler are more preferable as a sensor material than the crosslinked product of Example 5 employing the lower-structured general purpose carbon black as the electrically conductive filler, because the electrical conductivity monotonically changes with respect to the strain.

Figure 17:
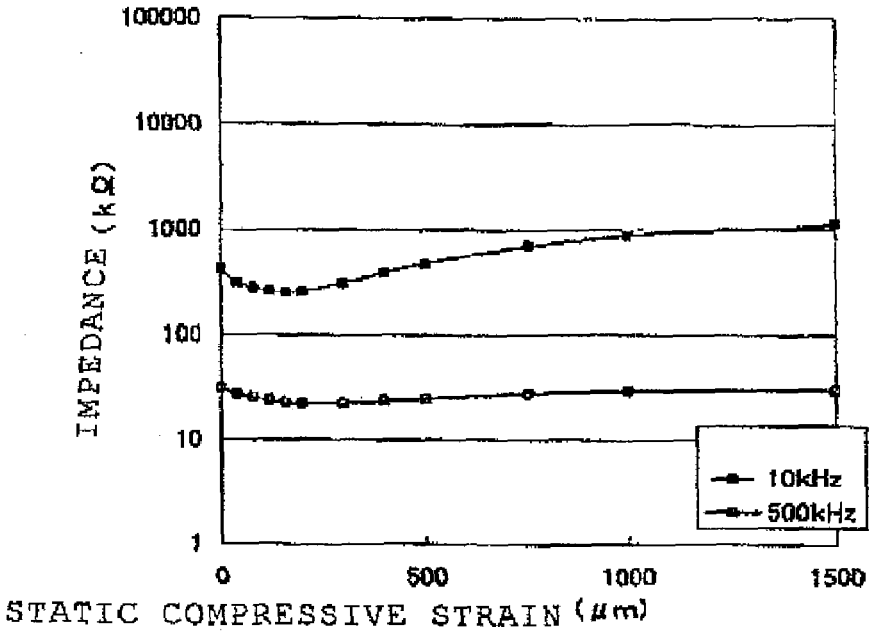
FIG. 17 is a graph showing relationships between the static compressive strain and the impedance at different frequencies in Example 5.

Relationships between the static compressive strain and the impedance at different frequencies (f=10 kHz and 500 kHz) in Example 5 are shown in FIG. 17. The results shown in FIG. 17 indicate that the impedance changes according to the compressive strain in Example 5.

Comparative Example 1

Preparation of Crosslinked EPDM Containing Spherical Particulate Carbon Filler (Insulator)

An electrically conductive composition was prepared in substantially the same manner as in Example 1, except that the spherical particulate carbon filler (NICABEADS ICB0520 available from Nippon Carbon Co., Ltd.) was blended in a proportion of 100 parts (100 g) The spherical particulate carbon filler (electrically conductive filler) was present in a volume fraction of about 26 vol % in the electrically conductive composition, and had a percolation critical volume fraction (ϕc) of 43 vol % and a saturated volume fraction (ϕs) of 48 vol %.

Then, the electrically conductive composition was formed into an uncrosslinked rubber sheet having dimensions of 150 mm×1500 mm×2 mm (thickness). As in Example 1, the uncrosslinked rubber sheet was filled in a rectangular box-shaped mold having dimensions of 10 mm×10 mm×5 mm (height), and press-vulcanized at a temperature of 170° C. for 30 minutes with a pair of copper plates (electrodes) 6 attached to vertically opposite end faces of the filled sheet. Thus, a sensor body 7 of a crosslinked EPDM (crosslinked product) with the electrodes 6 attached thereto was prepared as shown in FIG. 6. As in Example 1, impedance-frequency characteristics (Z-f) were determined with a thicknesswise compressive strain applied to the sensor body as shown in FIG. 7. The results are shown in FIG. 18.

Figure 18:
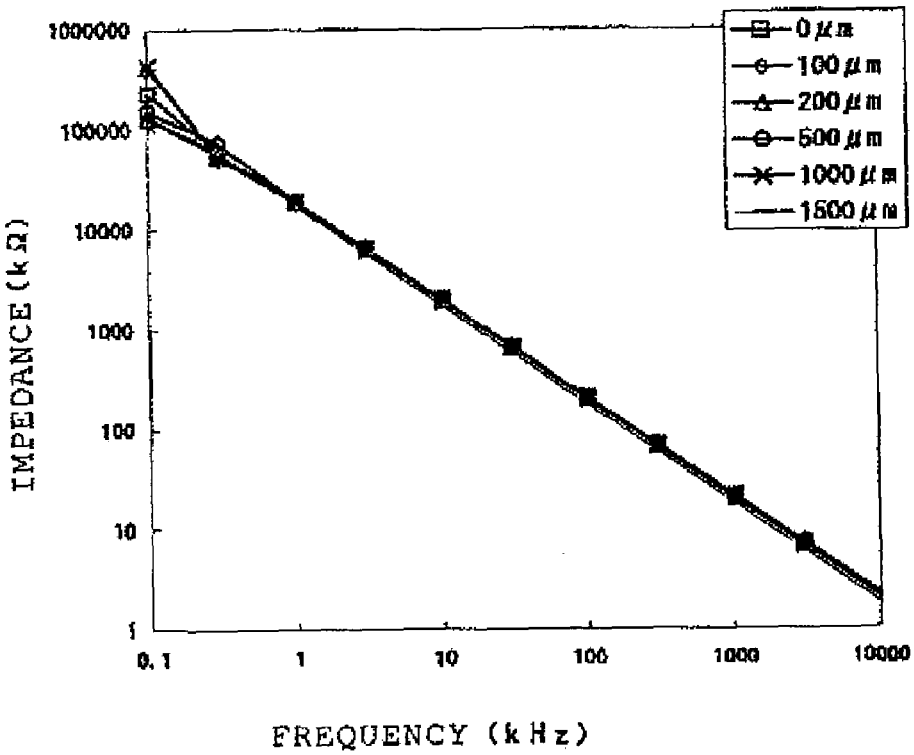
FIG. 18 is a graph showing the impedance-frequency characteristics (Z-f) of Comparative Example 1 for different static compressive strains.

As indicated by the results shown in FIG. 18, the crosslinked product of Comparative Example 1 was an insulator with no change in impedance responsive to application of strain. Therefore, it is difficult to employ the crosslinked product for sensing the strain. In Comparative Example 1, a combination of the electrically conductive filler and the elastomer ensuring a critical volume fraction (ϕc) of not less than 30 vol. % were employed as in Examples 1 to 3, but the volume fraction (packing amount) of the electrically conductive filler was less than the critical volume fraction (ϕc), so that the electrically conductive filler particles are not present substantially in the closest packed state. Therefore, the crosslinked product was insulative with no change in electrical conduction (with an extremely high resistance R or R=∞ (infinitely great)) without formation of electrical conduction paths even under strain.

Comparative Example 2

First, 100 parts (100 g) of a natural rubber (a ribbed smoked sheet #3 W18370), 5 parts (5 g) of zinc oxide (two types of zinc oxide available from Hakusui Tech Co., Ltd.) and 1 part (1 g) of stearic acid (LUNAC S30 available from Kao Corporation) were kneaded by a roll kneader. Then, 100 parts (100 g) of a HAF (High Abrasion Furnace) carbon black (SHOBLACK N330 available from Cabot Japan K.K. and having an average particle diameter of 0.03 μm) was added, and mixed and dispersed in the resulting mixture by the roll kneader. In turn, 1 part (1 g) of cyclohexyl-benzothiazole sulfenamide (NOCCELER CZ available from Ouchi Shinko Chemical Industry Co., Ltd.) as a vulcanization accelerating agent and 1.5 parts (1.5 g) of sulfur (SULFAX T-10 available from Tsurumi Chemical Industry Co., Ltd.) were added, and mixed and dispersed in the resulting mixture by the roll kneader. Thus, an electrically conductive composition was prepared. The HAF carbon black (electrically conductive filler) was present in a volume fraction of about 33 vol % in the electrically conductive composition, and had a percolation critical volume fraction (ϕc) of 27 vol % and a saturated volume fraction (ϕs) of 33 vol %.

Subsequently, the electrically conductive composition was formed into an uncrosslinked rubber sheet having dimensions of 150 mm×1500 mm×2 mm (thickness). As in Example 1, the uncrosslinked rubber sheet was filled in a rectangular box-shaped mold having dimensions of 10 mm×10 mm×3 mm (height), and press-vulcanized at a temperature of 150° C. for 20 minutes with a pair of copper plates (electrodes) 6 attached to vertically opposite end faces of the filled sheet. Thus, a sensor body 7 of a crosslinked natural rubber with the electrodes 6 attached thereto was prepared as shown in FIG. 6. As in Example 1, impedance-frequency characteristics (Z-f) were determined with a thicknesswise compressive strain applied to the sensor body as shown in FIG. 7. The results are shown in FIG. 19.

Figure 19:
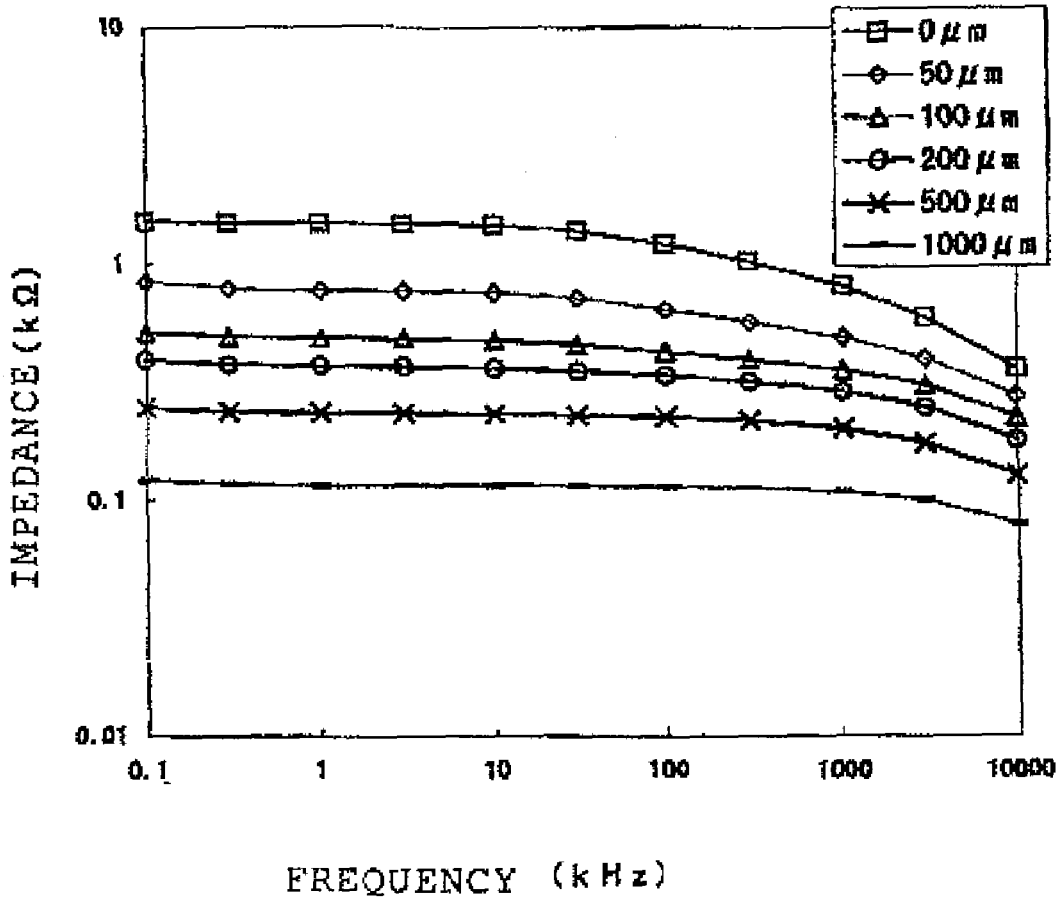
FIG. 19 is a graph showing the impedance-frequency characteristics (Z-f) of Comparative Example 2 for different static compressive strains.

As indicated by the results shown in FIG. 19, the crosslinked product was a high conductors and its resistance was slightly reduced in response to the application of the strain (the electrical conductivity was improved by the compressive strain). However, a change in resistance was small, so that the crosslinked product was unacceptable for use as a resistance increasing type sensor material intended by the present invention.

The inventive crosslinked elastomer body may be employed, for example, for an automotive seating state detection sensor, a bed surface pressure distribution sensor and a drawing tablet sensor which are based on detection of a surface pressure, and an automotive crash state detection sensor, a robot joint bending state detection sensor, a living body motion detection sensor (for motion capture and for detection of a breathing state, a muscle relaxing state and other living body motions) and a window glass breakage detection sensor which are based on detection of a bending state, and the like.

What is claimed is:

1. A crosslinked elastomer body for a sensor, which is composed of an electrically conductive composition comprising an electrically conductive filler and an insulative elastomer as essential components, the elastomer being at least one selected from the group consisting of silicone rubbers, ethylene-propylene copolymer rubbers, natural rubbers, styrene-butadiene copolymer rubbers, acrylonitrile-butadiene copolymer rubbers and acryl rubbers, wherein the electrically conductive filler is a spherical carbon black in a spherical particulate form and has an average particle diameter of 0.05 to 100 μm, wherein the electrically conductive filler has a critical volume fraction (ϕc) of not less than 30 vol % as determined at a first inflection point of a percolation curve at which an insulator-conductor transition occurs with an electrical resistance steeply reduced when the electrically conductive filler is gradually added to the elastomer, wherein the electrically conductive filler is present in a volume fraction not less than the critical volume fraction (ϕc) in the composition, whereby a resistance of the elastomer body observed under compressive strain or bending strain increases according to the strain as compared to a resistance of the elastomer body observed under no strain whereby the resistance changing range of the elastomer body can be controlled from one to five or more orders of magnitude.

2. A crosslinked elastomer body as set forth in claim 1, wherein the electrically conductive filler has a saturated volume fraction (ϕs) of not less than 35 vol % as determined at a second inflection point of the percolation curve at which a change in electrical resistance is reduced to be saturated even with further addition of the electrically conductive filler, wherein the electrically conductive filler is present in a volume fraction not less than the saturated volume fraction (ϕs) in the composition.

3. A crosslinked elastomer body as set forth in claim 1, wherein a gel fraction as calculated from the following expression (1) is not greater than 15%:

$$\text{Gel Fraction}(\%) = \frac{(Wg - Wf)}{Wf} \times 100 \quad (1)$$

wherein Wg is the weight of an insoluble portion of the electrically conductive composition obtained by dissolving the electrically conductive composition in a good solvent for the elastomer before crosslinking (the weight of a gel composed of the electrically conductive filler with the elastomer), and Wf is the weight of the electrically conductive filler.

4. A crosslinked elastomer body as set forth in claim 1, which has opposite strain application surfaces, at least one of which is fitted with a restriction plate.

5. A production method for producing a crosslinked elastomer body as recited in claim 1, the production method comprising the steps of:

providing an electrically conductive filler of a spherical carbon black in a spherical particulate form having an average particle diameter of 0.05 to 100 μm and an insulative elastomer being at least one selected from the group consisting of silicone rubbers, ethylene-propylene copolymer rubbers, natural rubbers, styrene-butadiene copolymer rubbers, acrylonitrile-butadiene copolymer rubbers and acryl rubbers;

preparing an electrically conductive composition by mixing the electrically conductive filler and the elastomer as essential components and a vulcanizing agent as an optional component, the electrically conductive filler being present in a volume fraction of not less than 30 vol % in the electrically conductive composition; and forming the electrically conductive composition into a predetermined shape and then crosslinking the composition.

* * * * *